US007743950B2

(12) United States Patent
Tsai

(10) Patent No.: US 7,743,950 B2
(45) Date of Patent: Jun. 29, 2010

(54) DEVICE FOR HOLDING AND ACTUATING A SPRAYER

(75) Inventor: Eric Tsai, Tali (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 283 days.

(21) Appl. No.: 11/744,942

(22) Filed: May 7, 2007

(65) Prior Publication Data

US 2008/0054025 A1 Mar. 6, 2008

Related U.S. Application Data

(63) Continuation-in-part of application No. 11/470,423, filed on Sep. 6, 2006.

(51) Int. Cl.
*B65D 83/18* (2006.01)
*B65D 83/20* (2006.01)

(52) U.S. Cl. ..... 222/323; 222/402.15; 222/474

(58) Field of Classification Search ..... 222/174, 222/323, 324, 402.13, 402.15, 472–475, 222/465.1; 239/375; 16/425; 294/28, 30, 294/31.1, 33, 34, 145; 215/396; 24/511, 24/546, 460, 462

See application file for complete search history.

(56) References Cited

U.S. PATENT DOCUMENTS

| | | | | | |
|---|---|---|---|---|---|
| 1,160,924 | A | | 11/1915 | Mangish | 99/306 |
| 1,404,669 | A | | 1/1922 | Turco | 294/28 |
| 1,970,631 | A | * | 8/1934 | Sherman | 222/498 |
| 2,336,924 | A | * | 12/1943 | Cordis | 222/89 |
| 2,618,499 | A | | 11/1952 | Scharf | 294/28 |
| 2,691,466 | A | * | 10/1954 | Efford et al. | 222/182 |
| 2,820,578 | A | * | 1/1958 | Dickman | 222/323 |
| 2,868,421 | A | * | 1/1959 | Schott | 222/473 |
| 2,960,260 | A | * | 11/1960 | Kutik | 222/473 |
| 3,734,357 | A | | 5/1973 | Batistelli et al. | 222/323 |
| 4,505,335 | A | | 3/1985 | Hayba | 222/402.15 |
| 4,660,745 | A | | 4/1987 | Hess, Jr. | 227/174 |
| 4,805,812 | A | * | 2/1989 | Brody | 222/402.11 |
| 5,137,180 | A | * | 8/1992 | Kieras | 222/108 |
| 5,819,985 | A | | 10/1998 | Brody | 222/153.09 |
| 6,029,862 | A | | 2/2000 | Jones | 222/402.15 |
| 2003/0218029 | A1 | | 11/2003 | Brody | 222/402.15 |

FOREIGN PATENT DOCUMENTS

GB 2080884 A * 2/1982

OTHER PUBLICATIONS

UK Patent Publication No. GB2218471 A1, No. GB2218471 A1, Nov. 15, 1989, 8 pages.
Taiwanese Patent Publication No. TW 479566, Mar. 11, 2002, 7 pages.
Taiwanese Patent Publication No. TW M254275, Jan. 1, 2005, 6 pages.
Japanese Patent Publication No. JP 07-22990, Apr. 25, 1995, 5 pages.

* cited by examiner

*Primary Examiner*—Kenneth Bomberg
(74) *Attorney, Agent, or Firm*—Alan Kamrath; Kamrath & Associates PA

(57) ABSTRACT

A device for holding and actuating a sprayer includes a holder and a trigger. The sprayer includes a neck, a rim formed on the neck, a push-button valve and a nozzle provided on the push-button valve. The holder includes a handle, a barrel extending from the handle and a clamp extending from the barrel. The clamp includes two jaws formed thereon, a mouth defined between the jaws and a gap defined between the jaws. The neck of the sprayer can be pushed into the mouth through the gap. The trigger is connected to the holder so that the trigger is operable to push the push-button valve of the sprayer.

8 Claims, 8 Drawing Sheets

DEVICE FOR HOLDING AND ACTUATING A SPRAYER

CROSS-REFERENCE

The present application is a continuation-in-part application of U.S. patent application Ser. No. 11/470,423, filed on 6 Sep. 2006, of which the entire disclosure is incorporated herein.

BACKGROUND OF INVENTION

1. Field of Invention

The present invention relates to a device for holding and actuating a sprayer.

2. Related Prior Art

Disclosed in U.S. Pat. No. 5,819,985 is a device 10 for actuating and holding a sprayer 12. The sprayer 12 includes a push-button valve 14 and a rim 26. The actuating and holding device 10 includes a body 16 and a locking ring 38.

The body 16 includes a handle 18 and a forward portion 20. The forward portion 20 includes an engagement element 22 for engagement with the rim 26 of the sprayer 12. The engagement element 22 includes a gap 24 defined therein, cam surfaces 52 formed on an external edge and a slot 46 defined in the external edge. A trigger 36 is provided on the handle 18. A lever 30 includes an end located in the gap 24 and an opposite end connected to the trigger 36.

The locking ring 38 includes a straight portion 40, two prongs 44 extended from an internal edge and an engagement finger 48 extended from the internal edge. The engagement finger 48 is located corresponding to the straight portion 40.

The locking ring 38 is installed around the engagement element 22. The internal edge of the locking ring 38 is in compliance with the external edge of the engagement element 22 including the cam surfaces 52. The prongs 44 are inserted in the slot 46. Thus, the locking ring 38 is not rotational relative to the engagement element 22. When the trigger 36 is operated, the push-button valve 14 is pushed via the lever 30.

There are problems encountered in the use of this conventional actuating and holding device 10. Firstly, it is not durable. The engagement element 22 is made of plastic. The cam surfaces 52 are worn away after some time of use so that the contact between the external edge of the engagement element 22 and the internal edge of the locking ring 38 is loose.

Secondly, it is inconvenient. The engagement finger 48 must be pushed downwards so that the prongs 44 can be inserted into the slot 46. The engagement finger 48 must be pushed upwards so that the prongs 44 can be removed from the slot 46. Space around the engagement finger 48 is, however, limited and renders it difficult to operate the engagement finger 48. Moreover, the locking ring 38 is arranged around the engagement element 22 after the engagement element 22 is arranged around the rim 26. The area of the locking ring 38 and that of the engagement element 22 are, however, limited and render it difficult to operate the locking ring 38 and the engagement element 22.

Therefore, the present invention is intended to obviate or at least alleviate the problems encountered in the prior art.

SUMMARY OF INVENTION

According to the present invention, a device is disclosed for holding and actuating a sprayer. The sprayer includes a neck, a rim formed on the neck, a push-button valve and a nozzle provided on the push-button valve. The device includes a holder and a trigger. The holder includes a handle, a barrel extending from the handle and a clamp extending from the barrel. The clamp includes two jaws formed thereon, a mouth defined between the jaws and a gap defined between the jaws. The neck of the sprayer can be pushed into the mouth through the gap. The trigger is connected to the holder so that the trigger is operable to push the push-button valve of the sprayer.

The primary advantage of the device according to the present invention is easy operation, because the neck of the sprayer can easily be pushed into the mouth of the clamp through the gap of the clamp.

Other advantages and features of the present invention will become apparent from the following description referring to the drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
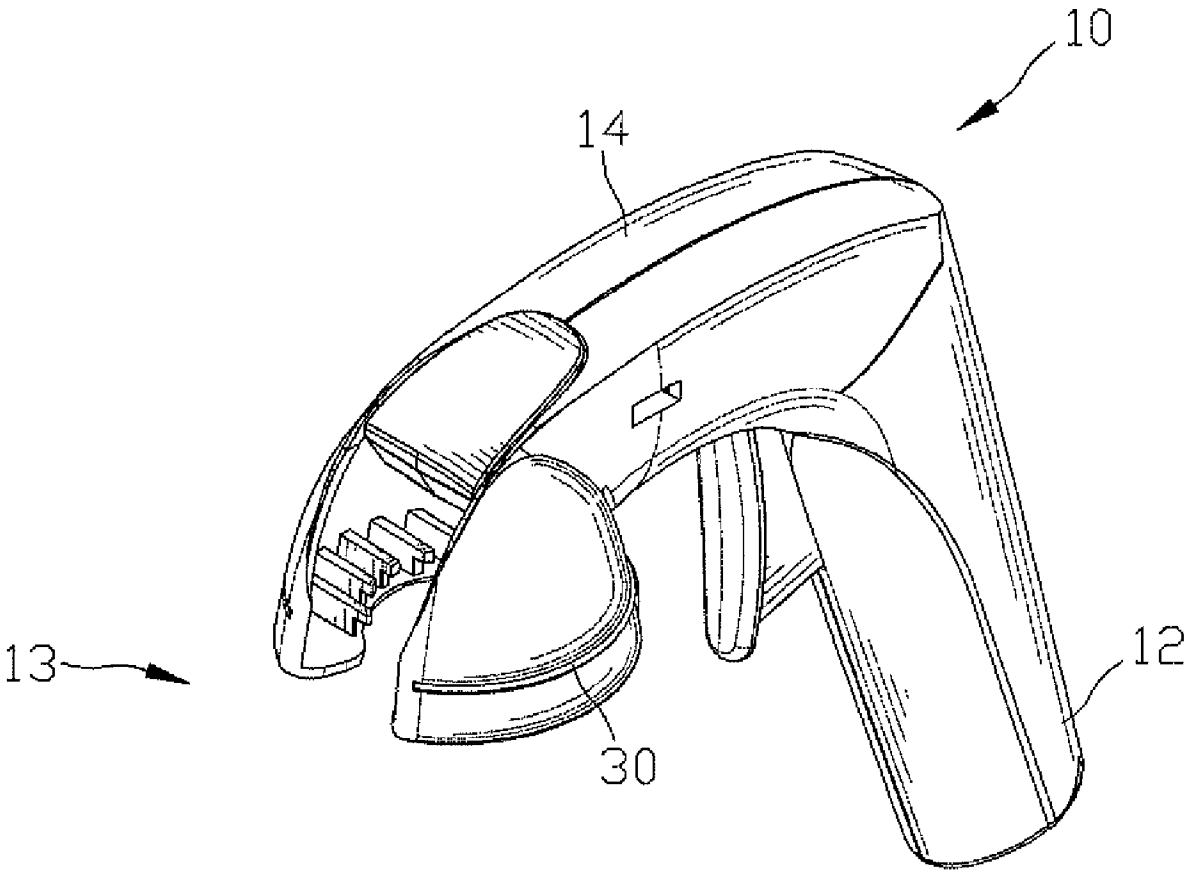
FIG. 1 is a perspective view of a holding and actuating device according to the preferred embodiment of the present invention.
Figure 2:
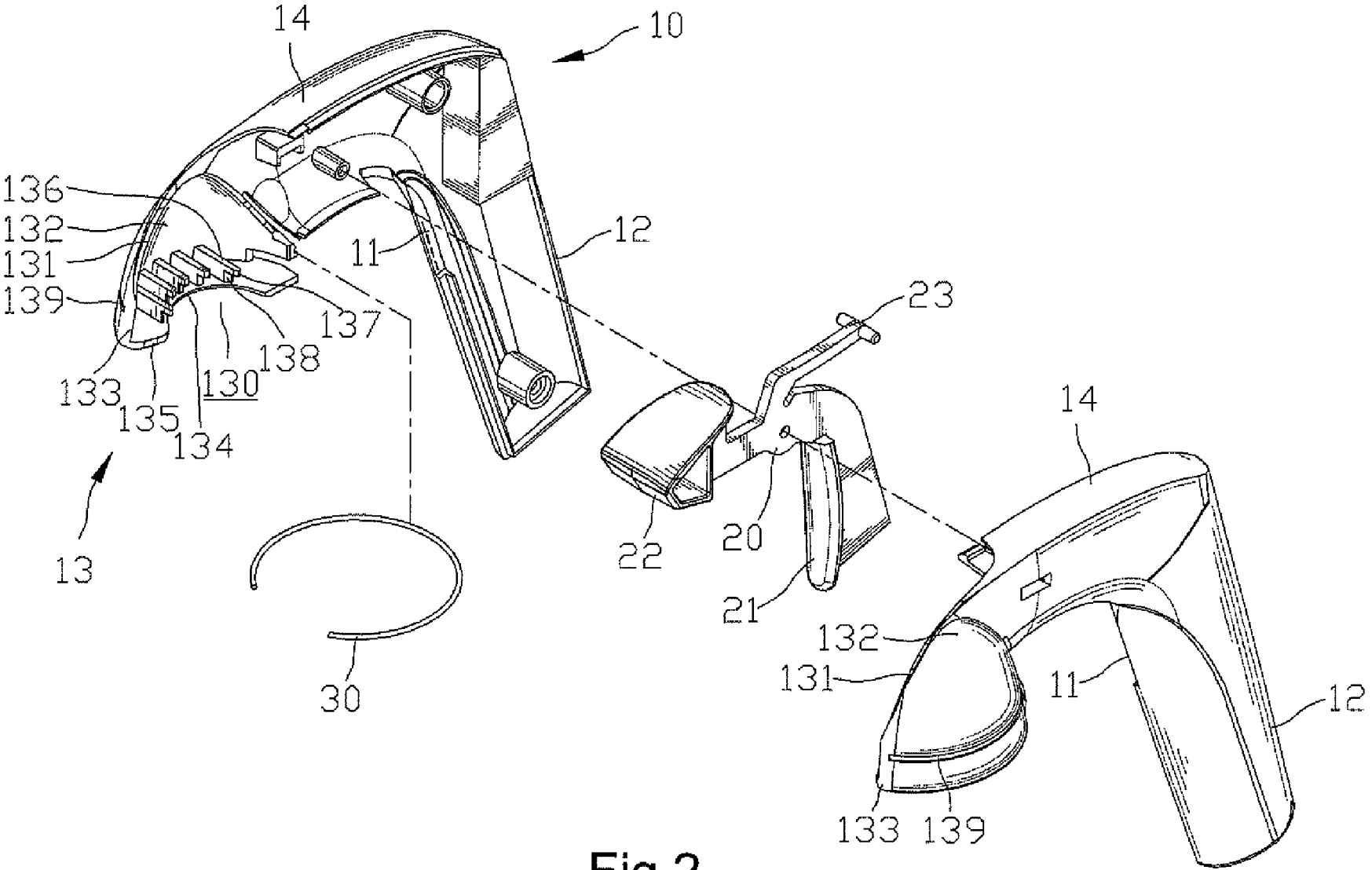
FIG. 2 is an exploded view of the holding and actuating device shown in FIG. 1.
Figure 3:
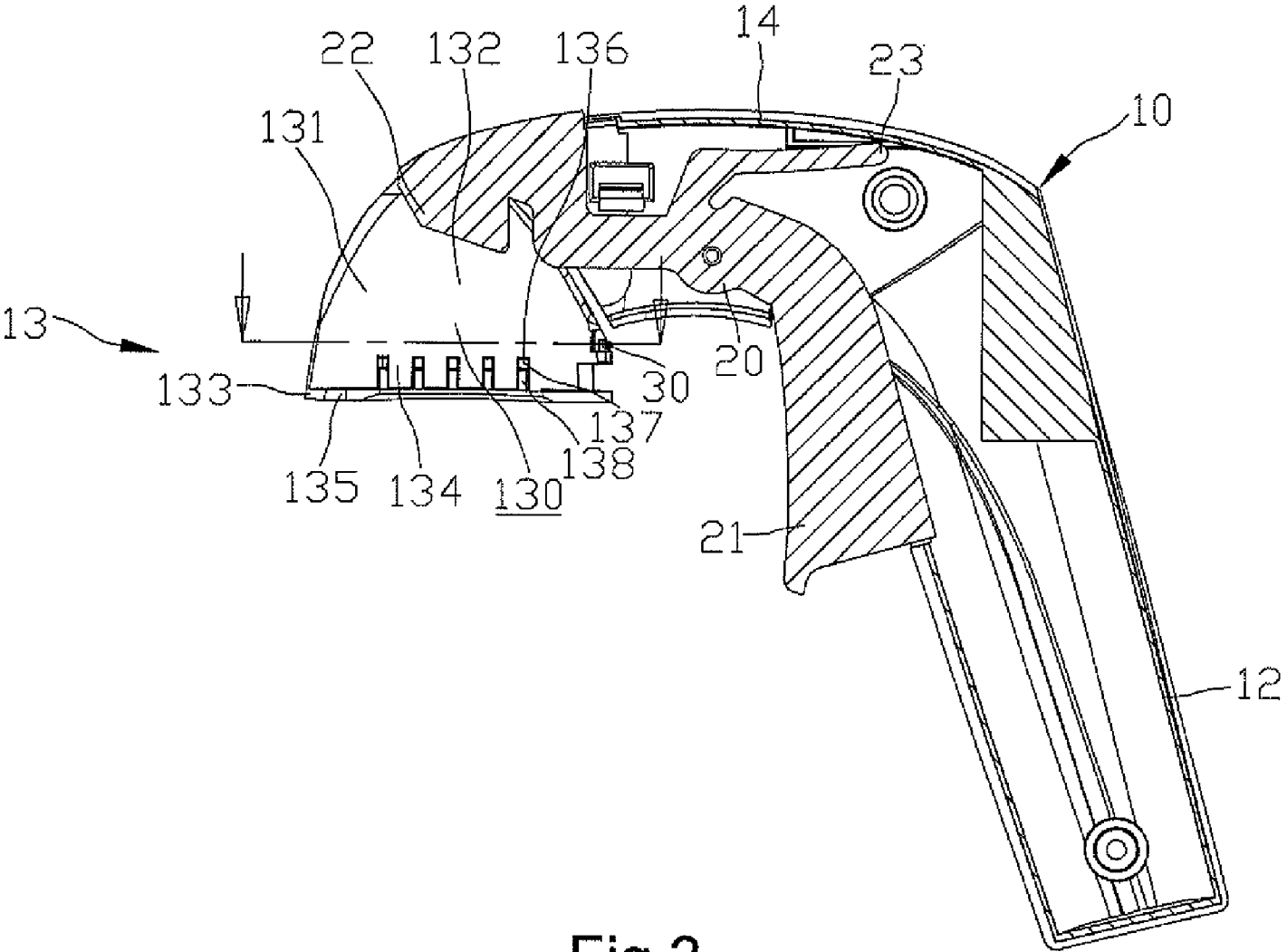
FIG. 3 is a cross-sectional view of the holding and actuating device shown in FIG. 1.
Figure 4:
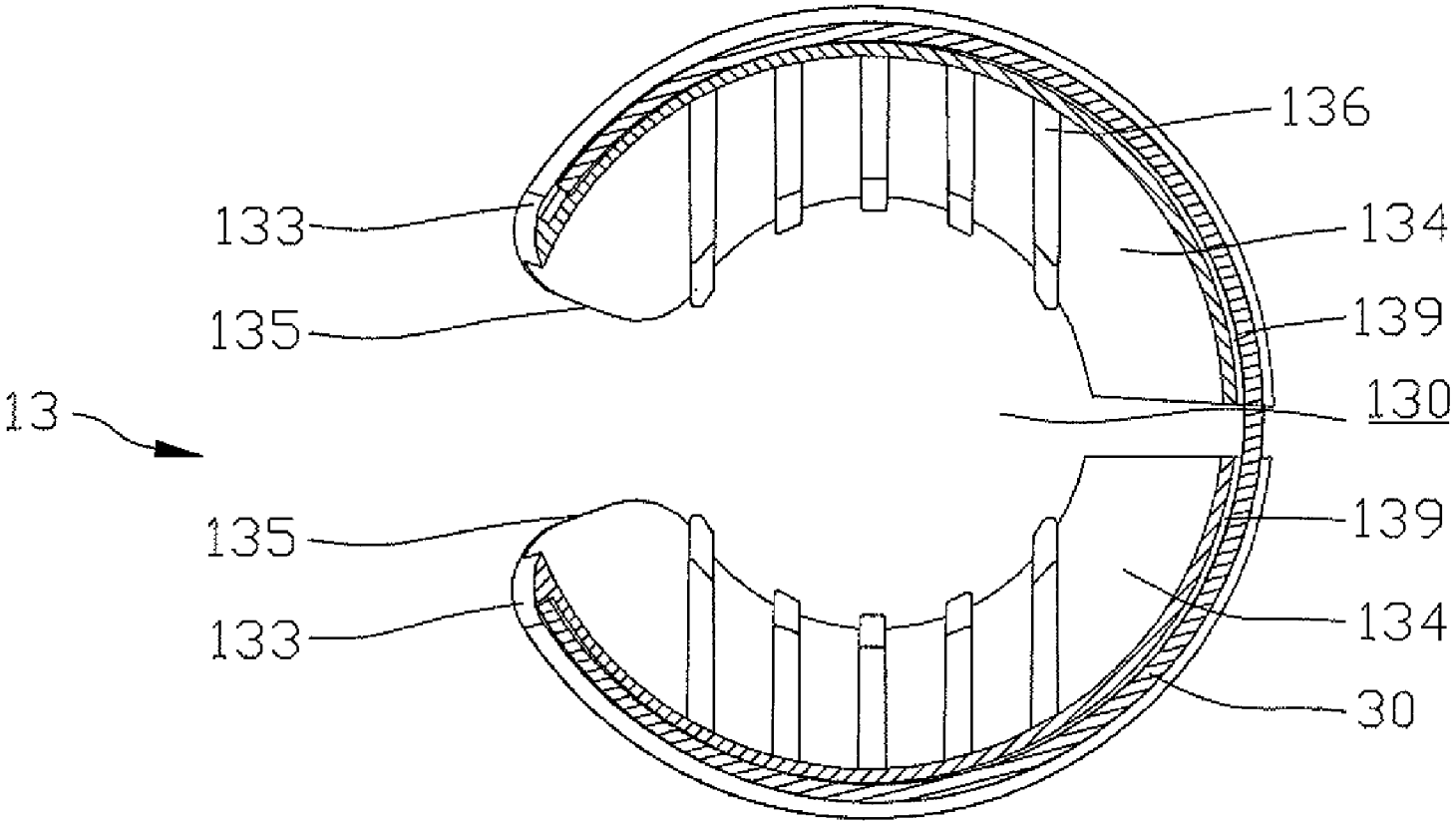
FIG. 4 is another cross-sectional view of the holding and actuating device in another position than shown in FIG. 3.

Referring to FIGS. 1 through 8, there is shown a device for holding and actuating a sprayer 50 according to the preferred embodiment of the present invention. The sprayer 50 includes a neck 52 formed thereon, a rim 53 formed around the neck 52, a push-button valve 54 provided on the neck 52 and a nozzle 51 provided on the push-button valve 54.

The holding and actuating device includes a holder 10, an elastic element 30 provided on the holder 10 and a trigger 20 provided on the holder 10. The holder 10 is used to hold the rim 53 of the sprayer 50. The elastic element 30 is used to enhance the holder 10 when holding the rim 53. The trigger 20 is operable to actuate the push-button valve 54.

The holder 10 includes a handle 12, a barrel 14 extended from the handle 12 and a clamp 13 extended from the barrel 14. The holder 10 is made of two halves 11 joined together. The holder 10 is hollow.

The clamp 13 includes a mouth 130 defined therein and a vent 131 in communication with the mouth 130. The mouth 130 is used to receive the neck 52 of the sprayer 50. Spray can travel to the exterior from the nozzle 51 of the sprayer 50 through the vent 131. The clamp 13 includes two jaws 132 formed thereon and a gap 133 defined between the jaws 132. A groove 139 is defined in the periphery of the clamp 13. The elastic element 30 is a C-clip disposed in the groove 139.

Thus, the elastic element 30 enhances the clamp 13 when holding the neck 52 of the sprayer 50.

Each of the jaws 132 includes a concave edge 134 formed thereon, a rounded edge 135 formed next to the concave edge 134 and a plurality of buckles 136 formed next to the concave edge 134. The concave edges 134 of the jaws 132 are used for engagement with the neck 52 of the sprayer 50. The neck 52 of the sprayer 50 can be pushed against the rounded edges 135 of the jaws 132 for opening the jaws 132 so that the neck 52 of the sprayer 50 can be moved into the mouth 130.

Each of the buckles 136 includes an upper portion 137 for contact with the top of the neck 52 of the sprayer 50 and a lower portion 138 for contact with the periphery of the neck 52 of the sprayer 50.

The trigger 20 is pivotally connected to the barrel 14. The trigger 20 includes a first portion 21 located before the handle 12, a second portion 22 for contact with the push-button valve 54 of the sprayer 50 and a third portion 23 connected to the barrel 14. The third portion 23 of the trigger 20 is an elastic portion for returning the trigger 20 to its normal position after it is operated and released.

Figure 5:
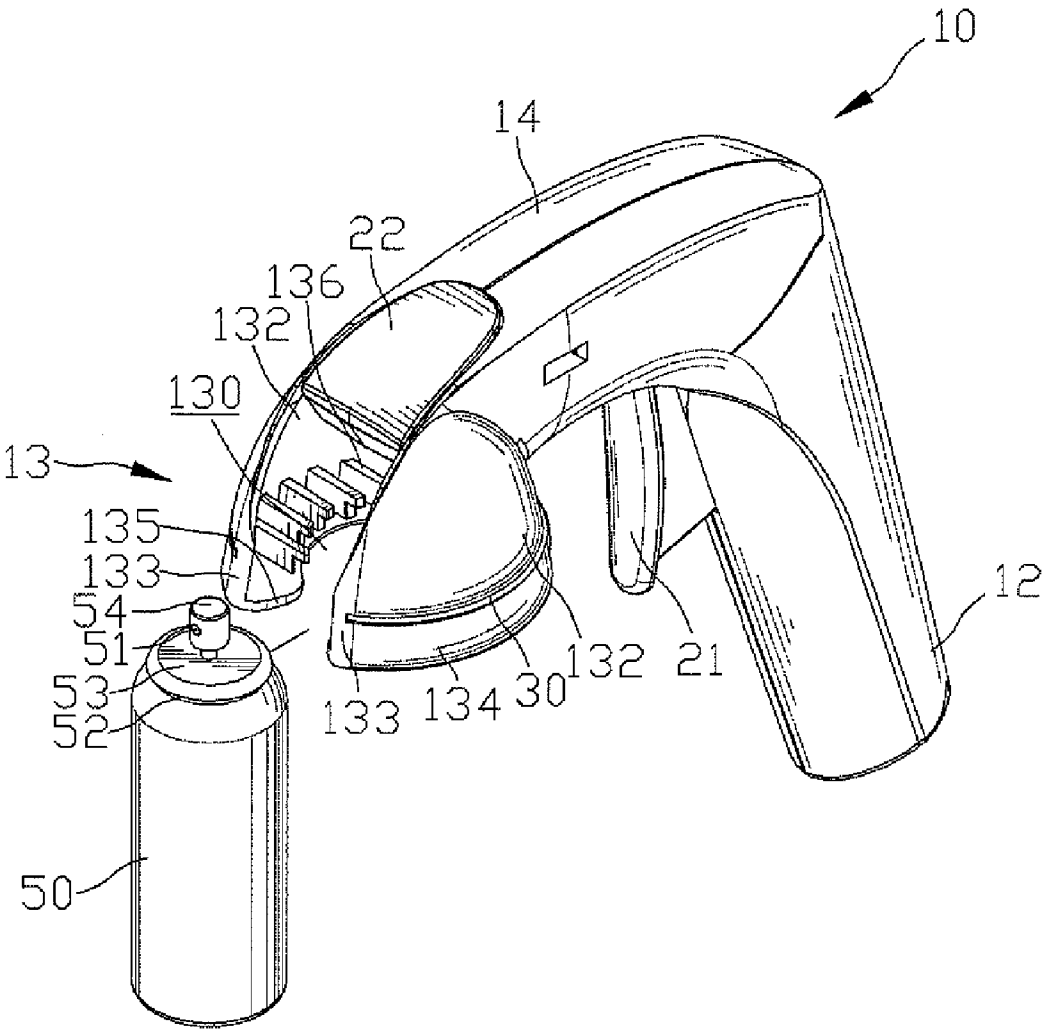
FIG. 5 is a perspective view of a sprayer to be held by the holding and actuating device shown in FIG. 1.
Figure 6:
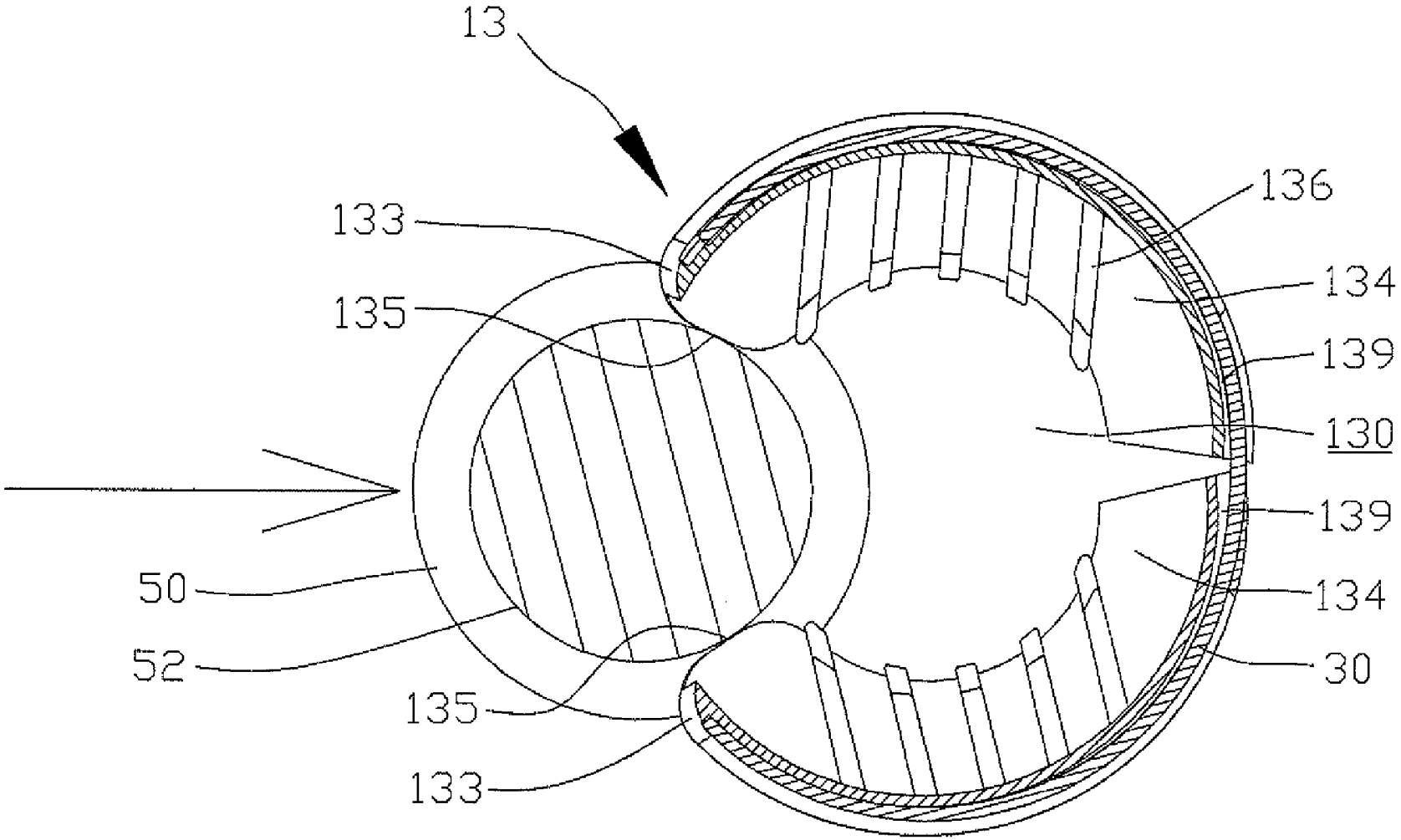
FIG. 6 is a cross-sectional view of the sprayer just in contact with the holding and actuating device shown in FIG. 5.

Referring to FIGS. 5 and 6, the neck 52 of the sprayer 50 is pushed against the rounded edges 135 of the jaws 132 for opening the jaws 132. As the jaws 132 are opened, the elastic element 30 is loaded.

Figure 7:
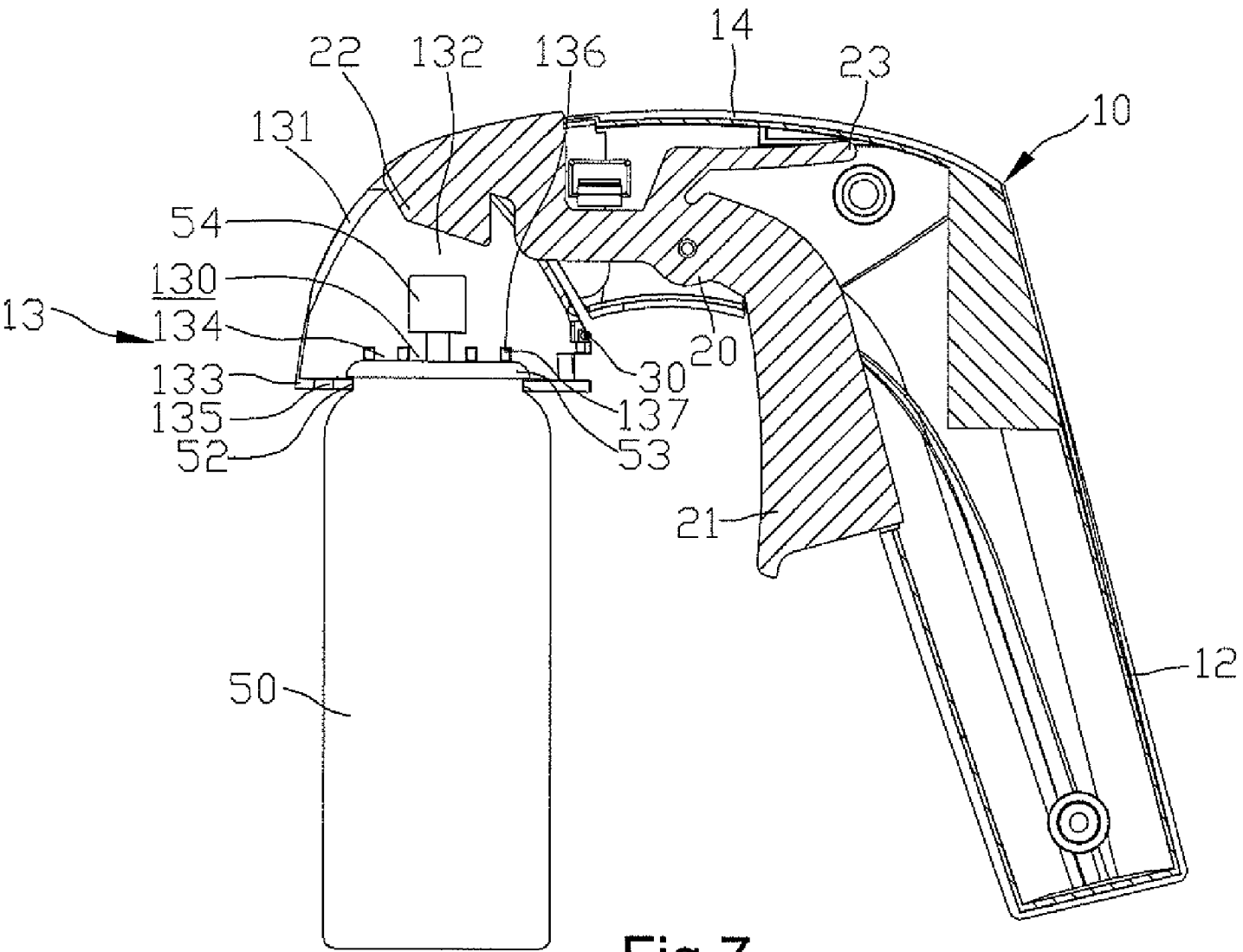
FIG. 7 is a cross-sectional view of the sprayer held by the holding and actuating device of FIG. 5.
Figure 8:
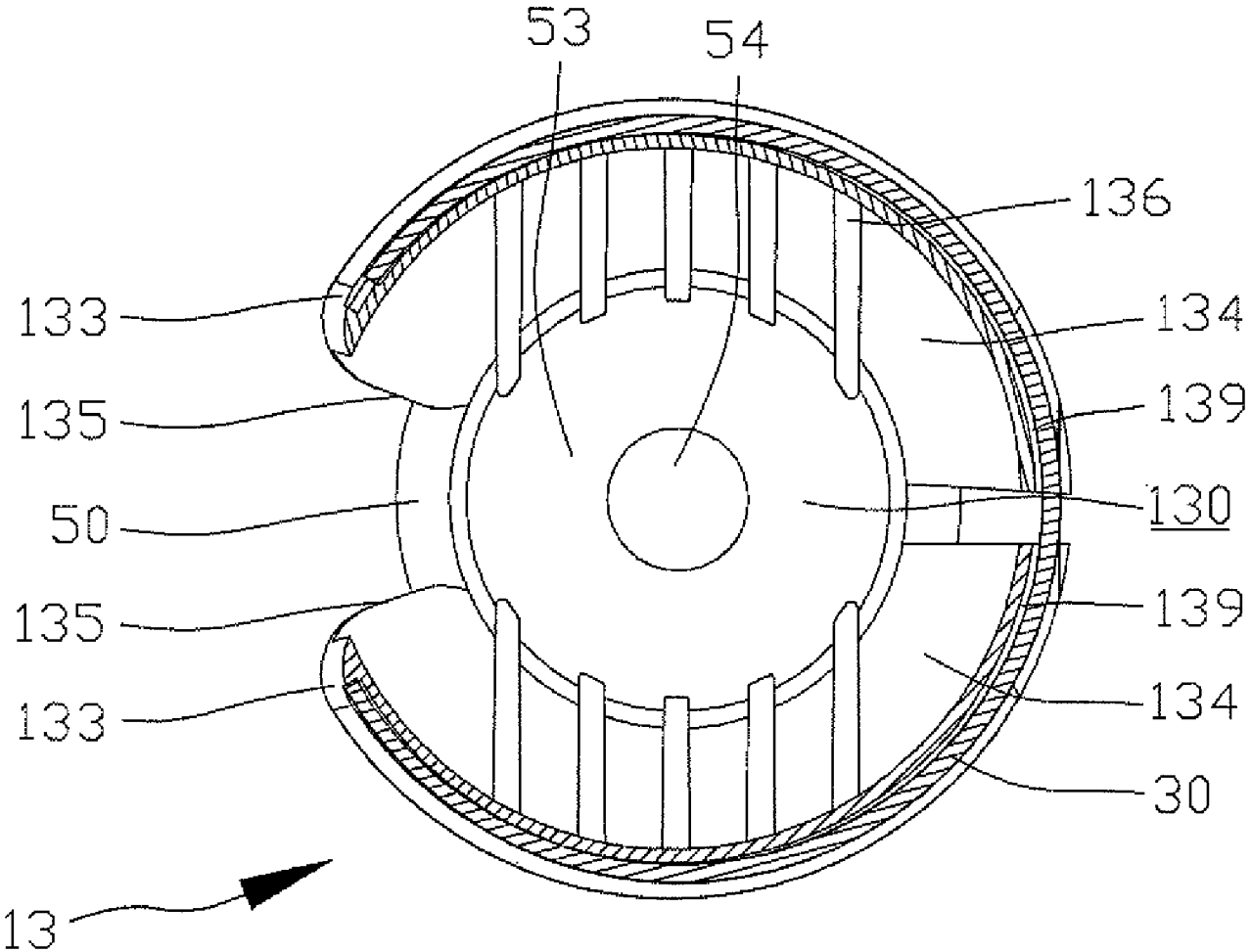
FIG. 8 is another cross-sectional view of the can held by the holding and actuating device shown in FIG. 7.

Referring to FIGS. 7 and 8, the neck 52 of the sprayer 50 is disposed in the mouth 130. The upper portions 137 of the buckles 136 are in contact with the top of the neck 52 of the sprayer 50 and the lower portions 138 of the buckles 136 are in contact with the periphery of the neck 52 of the sprayer 50. The elastic element 30 returns the clamp 13 to its normal position and enhances the clamp 13 when holding the neck 52 of the sprayer 50.

The holding and actuating device according to the present invention exhibits several advantages. Firstly, its operation is easy because of the gap 133 and the rounded edges 135 against which the neck 52 of the sprayer 50 can easily be pushed into the mouth 130 of the clamp 13.

Secondly, it is reliable for using the elastic element 30 to enhance the clamp 13 for clamping the neck 52 of the sprayer 50.

The present invention has been described via the detailed illustration of the preferred embodiment. Those skilled in the sprayer art can derive variations from the preferred embodiment without departing from the scope of the present invention. Therefore, the preferred embodiment shall not limit the scope of the present invention defined in the claims.

The invention claimed is:

1. A device for holding and actuating a sprayer comprising a neck, a rim formed on the neck, a push-button valve and a nozzle provided on the push-button valve, with the device comprising:

a holder comprising a handle, a barrel extending from the handle and a clamp extending from the barrel, with the clamp comprising a mouth defined therein, two jaws each having an end and a groove defined on an outer periphery of the clamp, with the holder including first and second halves separately formed from each other and joined together, with each of the first and second halves including one of the two jaws, with the two jaws moveable in a movement plane between a normal position and an opened position, with a gap defined in the movement plane between the ends of the two jaws, with the gap being greater in the opened position than in the normal position, wherein the neck of the sprayer can be pushed parallel to the rim and in the movement plane into the mouth through the gap;

a trigger connected to the holder and operable to push the push-button valve of the sprayer; and an elastic element received in the groove of the clamp and biasing the two jaws from the opened position to the normal position, wherein the elastic element comprises a C-clip, with the C-clip not extending into the gap, with the elastic element enhancing holding the neck of the sprayer.

2. The device according to claim 1 wherein each of the two jaws comprises a concave edge for contact with the neck of the sprayer.

3. The device according to claim 2 wherein each of the two jaws comprises a rounded edge formed adjacent to the concave edge so that the neck of the sprayer is easily pushed into the mouth against the rounded edges of the jaws.

4. The device according to claim 1 wherein the clamp comprises a vent through which spray can travel to the exterior from the nozzle of the sprayer.

5. The device according to claim 1 wherein the clamp comprises at least one buckle formed on each of the two jaws for engagement with the rim of the sprayer.

6. The device according to claim 5 wherein the buckle comprises a lower portion for contact with a periphery of the rim of the sprayer and an upper portion extended from the lower portion for contact with a top of the rim of the sprayer.

7. The device according to claim 5 wherein the trigger comprises a first portion located before the handle and a second portion disposed in the clamp for contact with the push-button valve of the sprayer.

8. The device according to claim 7 wherein the trigger comprises an elastic portion connected to the barrel for returning the trigger to its normal position after it is operated and released.

* * * * *